United States Patent [19]

Caruso

[11] 4,073,539

[45] Feb. 14, 1978

[54] BONDED CHAIR CONSTRUCTION

[75] Inventor: Jerome Caruso, Lake Forest, Ill.

[73] Assignee: Litton Business Systems, Inc., York, Pa.

[21] Appl. No.: 690,547

[22] Filed: May 27, 1976

[51] Int. Cl.[2] ..... A47C 7/02

[52] U.S. Cl. ..... 297/455; 297/DIG. 1; 297/DIG. 2

[58] Field of Search ..... 297/454–456, 297/458–460, DIG. 1, DIG. 2

[56] References Cited

U.S. PATENT DOCUMENTS

| | | | |
|---|---|---|---|
| 2,967,565 | 1/1961 | Schultz | 297/459 X |
| 3,669,499 | 6/1972 | Semplonius et al. | 297/455 |

*Primary Examiner*—James C. Mitchell

*Attorney, Agent, or Firm*—Robert F. Rotella; Norman Friedman

[57] ABSTRACT

An article of seating comprises a shell member and a skin member in contact with the shell member, the skin member being attached to the shell member throughout substantially the entire surface area of mutual contact between the skin member and the shell member.

11 Claims, 4 Drawing Figures

BONDED CHAIR CONSTRUCTION

BACKGROUND OF THE INVENTION

The present invention relates to furniture and more particularly to a method of constructing chairs and other types of seating and the article formed thereby.

The so-called shell chair has become a popular item of furniture by virtue of the ease in which materials such as plastics can be utilized in its construction. However, such articles must of necessity be fabricated of plastics having certain structural qualities which unfortunately have low esthetic appeal.

Such plastics are rigid while being lightweight but the exterior surface is unattractive and thus attempts have been made to cover or paint the surface to conceal it. The approach of painting has been unsuccessfull since plastics of this type have varying absorbtion rates giving rise to expensive quality control procedures to insure a uniform product.

One solution to this problem has been the development of double shell versions in which a second shell-shaped member is used to conceal the primary member which gives the chair its structural strength. However, this approach gives rise to additional problems particularly with regard to providing adequate support for the second shell as well as closely matching the shape of the primary shell.

One prior art approach for fastening the second shell to the primary shell utilizes clips which support the second shell only at its periphery, the two shells actually being spaced throughout most of their common surface areas. Thus the second shell fails to add any structural rigidity to the chair structure as a whole.

OBJECTS AND SUMMARY OF THE INVENTION

The present invention overcomes the difficulties encountered in the prior art by providing a structural shell of foam plastic which is bonded, either by lamination or during a molding process, to a thermoplastic skin member so that the shell and skin are in substantially intimate contact throughout and become a unified article.

The skin member contributes greater impact strength and resistance to damage (such as nicks and scratches) to the construction compared with prior art methods which is further accentuated by the bonding between the shell and skin. Furthermore, the skin may be colored, textured or surface-finished in an unlimited range thereby increasing the esthetic appeal of the chair, an important consideration.

DETAILED DESCRIPTION OF THE INVENTION

Figure 1:
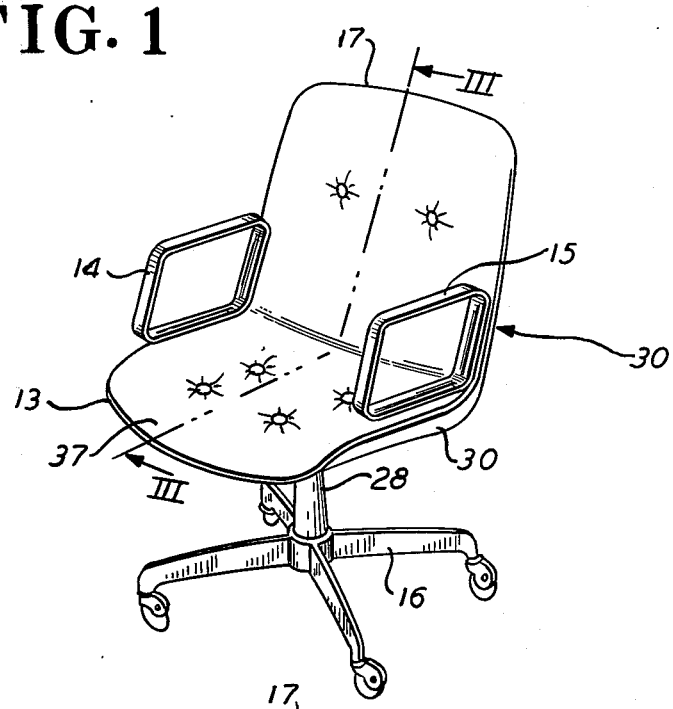
FIG. 1 is a perspective view of a chair according to the invention.

Referring to FIG. 1, the assembled chair 10 includes a structural body 30 forming a continuous back and seat comprised of a shell member and a skin member as hereinafter described. The chair seat portion 13 and back portion 17 may be covered with upholstery 37. A pair of arms 14 and 15 may also be provided if desired. A pedestal 16 is also joined to the undersurface of the chair seat by means of a supporting column 28.

Figure 2:
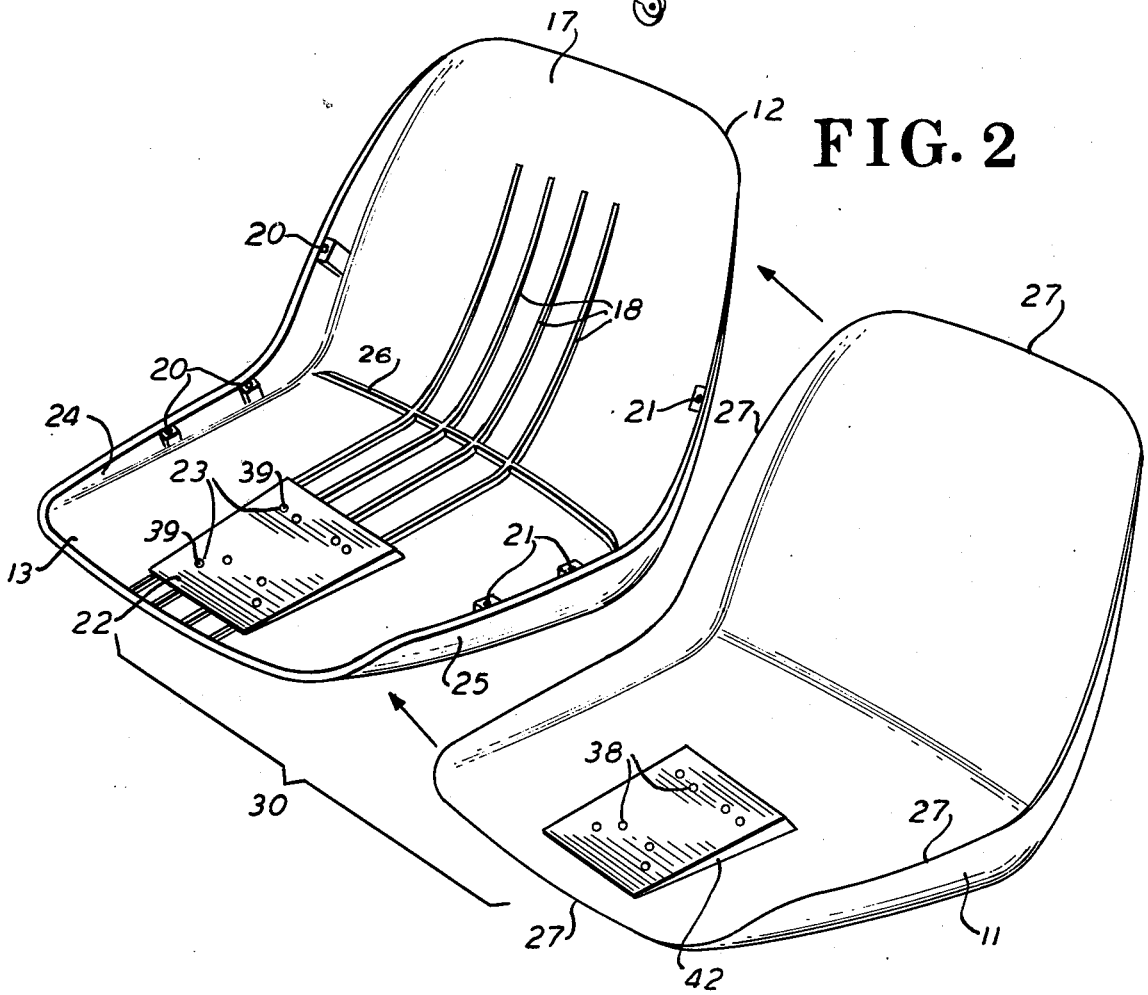
FIG. 2 is an exploded view of some of the components which comprise the chair.

As shown in FIG. 2, the structural portion 30 of the chair 10 includes a structural shell 12 having back and seat portions which generally define the shape of the finished chair as being gently curved throughout with upstanding walls 24, 25 at each side of the seat and back portions which taper at the extreme front and top of the shell.

In the preferred embodiment, the shell 12 is fabricated by injection molding of a structural foam plastic material. In one actually-constructed version of the chair, foamed structural polystyrene having a density on the order of 0.026 pounds per cubic inch and a thickness in the range of 0.3 inch was used for the shell 12.

The structural qualities of shell 12 are enhanced by also forming during molding a plurality of ribs 18 which extend in a longitudinal direction across the back and seat portions. A transversely extending rib 26 may also be provided for added strength at the transition between the back and seat portions.

Also formed during molding of shell 12 are a plurality of bosses 20, 21 which permit the attachment of the arms 14, 15, respectively. The bottom portion of shell 12 also includes a shelf 22 containing a plurality of holes 23 which may be formed either during molding or, after molding, by punching or drilling. The shelf 22 serves to accommodate the upper portion of the column 28 which may comprise a bracket to be joined by appropriate fasteners extending through holes 23 to the seat portion 12 of chair 10.

A skin member 11 is fabricated to have a shape and size conforming substantially with the back and seat portions of the rear of the structural shell 12 including a corresponding shelf portion 42 having holes 38. However, the outermost edge 27 of skin 11 may be offset to extend slightly away the edge of the corresponding outermost edge of the shell 12 when both are placed together as may be seen particularly in FIG. 3.

The skin member 11 may be formed of a thermoplastic material such as A.B.S., Royalite or equivalent type of plastic. In an actually-constructed version of the chair, the skin 11 was vacuum formed of .080 inch A.B.S. thermoplastic material.

A suitable adhesive is applied to the entire rear surface of shell 12. The skin 11 is then placed against the rear portions of shell 12 and even pressure is exerted against the external surface of the skin. Once the adhesive has cured, a composite laminated body 30 comprised of shell 12 and skin 11 is formed having high structural strength and surface integrity.

Figure 3:
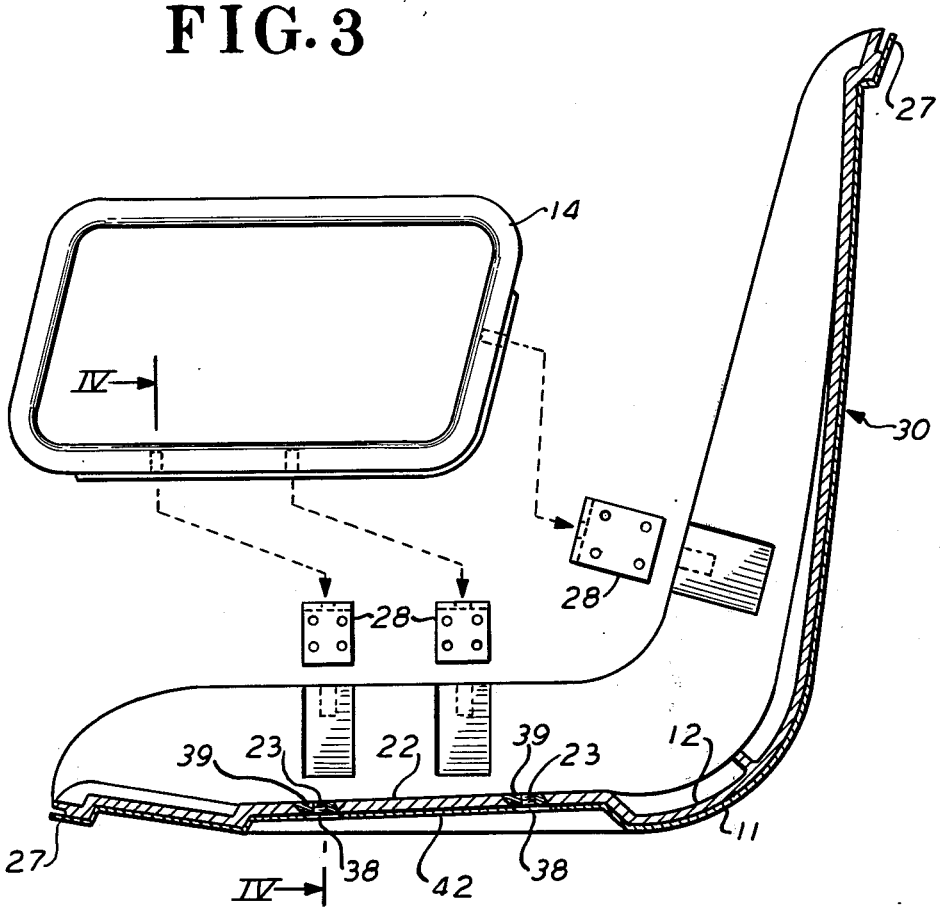
FIG. 3 is an exploded view, partially in section, taken along the plane III—III of FIG. 1.

It is to be noted that, as shown particularly in FIGS. 2 and 3, shell 12 and skin 11 are in intimate bonded contact throughout all of the mutually adjacent surfaces so that there are no voids or open spaces therebetween. In this way each component, the shell 12 and the skin 11, serves to provide structural strength to the composite body 30.

During fabrication of the shell 12, a plurality of female-threaded metal inserts 39 may be placed in the mold. The inserts 39 are molded as part of the shell 12 at each hole 23 and serve to accept the fasteners for joining the top of pedestal column 28 to the chair body 30. In this way metal-to-metal fastening is provided preventing excessive stresses from being applied directly to the plastic material of shell 12.

Figure 4:
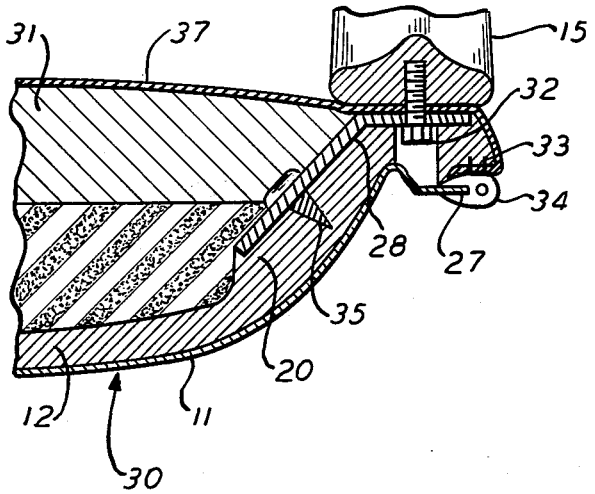
FIG. 4 is a segmentary cross sectional view taken along the plane IV—IV of FIG. 3.

As may best be seen in FIG. 4, the chair body 30 is upholstered by applying cushion material 31 such as soft urethane foam to the inside seat 13 and back 17 portions of the chair body 30. An upholstery cover 37 such as fabric, leather or vinyl plastic is then laid over the cushion material 31. The edge of cover 37 is then pulled over the edge of the chair body 30 and fastened by staples 33 to the shell portion 12 at desired intervals around the peripheral edge of the shell.

A flexible extrusion 34 which may be vinyl or rubber is then pressed over the offset edge 27 of skin 11 and thereby serves to conceal the staples 33.

Each arm, for example arm 15 (FIG. 4), is joined to the chair body 30 by means of conventional threaded fasteners inserted through holes in each of the bosses 20 and into corresponding holes provided in the lower and rear surfaces of each arm. A metal bracket 28 is interposed between the chair body 30 and the arm 15 (as well as the adjacent upholstery cover 37) to prevent excessive stresses which may be applied to the arms during use of the chair from being transferred directly to the plastic chair body 30. Each bracket 28 is angled to lie flush against the side of each boss 20 and is fastened to the boss by a plurality of fasteners 35.

The chair body 30 may also be constructed in the following manner. A previously-fabricated skin member 11 is placed in the mold employed to form the shell 12. The shell 12 is then molded of structural foam plastic material during which process the skin 11 adheres to the shell without need for any adhesive. The thus-formed chair body 30 is subsequently ejected from the mold as a composite structural component.

Although the illustrated embodiment of chair 10 is of the type known as an executive office chair it is to be understood that any other type of seating may be made in accordance with the invention. Thus, office secretarial chairs, lounge chairs, household seating, and the like with or without arms or with or without upholstery, may be similarly constructed according to the principles of the invention.

Accordingly, it is to be understood that many modifications and variations of the present invention will be obvious to those skilled in the art and, consequently, the scope of the invention is to be measured solely from the following claims.

What is claimed is:

1. An article of seating comprising:
a shell member; and
a skin member in contact with said shell member;
said skin member being attached to the side of said shell member oppositely of the side of said shell member closest to the body of a seated user by laminating throughout substantially the entire surface area of mutual contact between said skin member and said shell member.

2. An article of seating as set forth in claim 1, wherein:
said shell member comprises a continuous shell having first and second leg portions;
said first leg portion defining a back and said second leg portion defining a seat.

3. An article of seating as set forth in claim 2, wherein:
said skin member comprises a continuous sheetlike skin having a shape and size which conforms substantially to the shape and size of said shell member.

4. An article of seating as set forth in claim 3, wherein:
the rear of said shell is attached to the front of said skin.

5. An article of seating as set forth in claim 1, wherein:
said shell member is formed of structural foam plastic material.

6. An article of seating as set forth in claim 1, wherein:
said skin member is formed of thermoplastic material.

7. An article of seating as set forth in claim 1, wherein:
said skin member is attached to said shell member by adhesive bonding.

8. An article of seating as set forth in claim 3, wherein:
the peripheral edge of said skin member is separate from the corresponding edge of said shell member.

9. A method of making an article of seating comprising the steps of:
forming a shell member;
forming a skin member; and
attaching said skin member to the side of said shell member oppositely of the side of said shell member closest to the body of a seated user throughout substantially the entire surface area of mutual contact between said skin member and said shell member.

10. A method of making an article of seating as set forth in claim 9, further including the step of:
applying adhesive material to said shell member prior to said attaching step.

11. A method of making an article of seating as set forth in claim 10, wherein:
said skin member is attached to said shell member by pressure.

* * * * *